US011906196B2

(12) United States Patent
Diehl et al.

(10) Patent No.: US 11,906,196 B2
(45) Date of Patent: Feb. 20, 2024

(54) FAN MOUNTING ASSEMBLY SYSTEMS AND METHODS

(71) Applicant: Johnson Controls Tyco IP Holdings LLP, Milwaukee, WI (US)

(72) Inventors: April Mae Eberly Diehl, Spring Grove, PA (US); Kevin Lee Stein, Hellam, PA (US); Jeffrey Joseph Ronald, Dallastown, PA (US); John Russel Lauver, III, Glen Rock, PA (US); Craig Eric Adams, York, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 106 days.

(21) Appl. No.: 17/387,885

(22) Filed: Jul. 28, 2021

(65) Prior Publication Data

US 2023/0031104 A1 Feb. 2, 2023

(51) Int. Cl.

| | |
|---|---|
| ***F24F 13/20*** | (2006.01) |
| ***F24F 7/06*** | (2006.01) |
| ***F04D 29/62*** | (2006.01) |

(52) U.S. Cl.

CPC ..... *F24F 13/20* (2013.01); *F24F 7/06* (2013.01); *F04D 29/626* (2013.01); *F24F 2013/205* (2013.01)

(58) Field of Classification Search

CPC ..... F24F 13/20; F24F 2013/205; F24F 7/06; F04D 26/626

USPC ..... 417/360

See application file for complete search history.

(56) References Cited

U.S. PATENT DOCUMENTS

| | | | | |
|---|---|---|---|---|
| 9,482,439 | B2 | 11/2016 | Akhtar | |
| 9,739,491 | B2 | 8/2017 | Beermann et al. | |
| 2017/0219222 | A1* | 8/2017 | Hayashi | F24F 1/0063 |

FOREIGN PATENT DOCUMENTS

| | | | | |
|---|---|---|---|---|
| CN | 106714521 | A | * | 5/2017 |
| JP | 2000077875 | A | | 3/2000 |
| JP | 2013007543 | A | * | 1/2013 |
| JP | 2014119172 | A | * | 6/2014 |

* cited by examiner

*Primary Examiner* — Edelmira Bosques
*Assistant Examiner* — Michael James Giordano
(74) *Attorney, Agent, or Firm* — Fletcher Yoder, P.C.

(57) ABSTRACT

A mounting assembly for a fan of a heating, ventilation, and/or air conditioning (HVAC) system includes a frame configured to couple to the HVAC system. The frame includes a support rail having a flange. The mounting assembly includes a first guide rail coupled to the frame and having a first lip extending at an oblique angle relative to the flange. The mounting assembly also includes a second guide rail coupled to the frame and having a second lip extending at the oblique angle relative to the flange. The first and second lips are configured to support and guide translation of a chassis of the fan toward the support rail such that the chassis of the fan engages with the flange. The flange is configured to support the fan offset from the first and second lips in an installed configuration of the fan with the mounting assembly.

16 Claims, 13 Drawing Sheets

FAN MOUNTING ASSEMBLY SYSTEMS AND METHODS

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature, humidity, and/or air quality, for occupants of the respective environments. The HVAC system may regulate the environmental properties through delivery of a conditioned air flow to the environment. For example, the HVAC system may include an HVAC unit that is fluidly coupled to various rooms or spaces within the building via an air distribution system, such as a system of ductwork. The HVAC unit is configured to generate the conditioned air flow (e.g., heated air, cooled air, dehumidified air, filtered air) and typically includes a fan or blower that is operable to direct the conditioned air flow through the ductwork and into the spaces to be conditioned. In this manner, the HVAC unit facilitates regulation of environmental parameters within the rooms or spaces of the building.

The fan may be positioned within an enclosure or housing of the HVAC unit. As such, the fan may be difficult to access for inspection, maintenance, or other purposes. For example, in order to obtain suitable access to the fan, a service technician or other person may typically disassemble significant portions of the enclosure of the HVAC unit and/or of certain HVAC components that may be positioned adjacent to the fan. Thus, removal of the fan from the HVAC unit may be arduous and time consuming.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a mounting assembly for a fan of a heating, ventilation, and/or air conditioning (HVAC) system. The mounting assembly includes a frame configured to couple to the HVAC system. The frame includes a support rail having a flange. The mounting assembly includes a first guide rail coupled to the frame and having a first lip extending at an oblique angle relative to the flange. The mounting assembly also includes a second guide rail coupled to the frame and having a second lip extending at the oblique angle relative to the flange. The first and second lips are configured to support and guide translation of a chassis of the fan toward the support rail such that the chassis of the fan engages with the flange. The flange is configured to support the fan offset from the first and second lips in an installed configuration of the fan with the mounting assembly.

The present disclosure also relates to a mounting assembly for a fan of a heating, ventilation, and/or air conditioning (HVAC) system. The mounting assembly includes a frame defining an interior volume and having a first end configured to receive the fan and a second end opposite the first end. The mounting assembly also includes a plurality of guide rails coupled to the frame. Each guide rail of the plurality of guide rails includes a guide surface configured to guide translation of the fan through the first end of the frame, into the interior volume toward the second end of the frame, and into engagement with a support rail coupled to the frame such that the fan is positioned in a first orientation. The mounting assembly further includes a retention system configured to engage the fan to secure the fan in a second orientation within the interior volume, where the fan is disposed at an angle relative to the guide surfaces in the second orientation.

The present disclosure also relates to a fan assembly for a heating, ventilation, and/or air conditioning (HVAC) system. The fan assembly includes a fan configured to direct an air flow along a flow path of the HVAC system. The fan assembly also includes a frame having a support rail, where the support rail includes a flange configured to support the fan in an installed configuration. The fan assembly also includes a plurality of guide rails coupled to the frame, wherein each guide rail of the plurality of guide rails includes a lip extending along the frame at an oblique angle relative to the flange. The lips are configured to receive the fan to guide translation the fan toward the support rail and into engagement with the flange. The flange is configured to support the fan offset from the lips in the installed configuration of the fan.

BRIEF DESCRIPTION OF THE DRAWINGS

Various aspects of this disclosure may be better understood upon reading the following detailed description and upon reference to the drawings in which.

DETAILED DESCRIPTION

Figure 1:
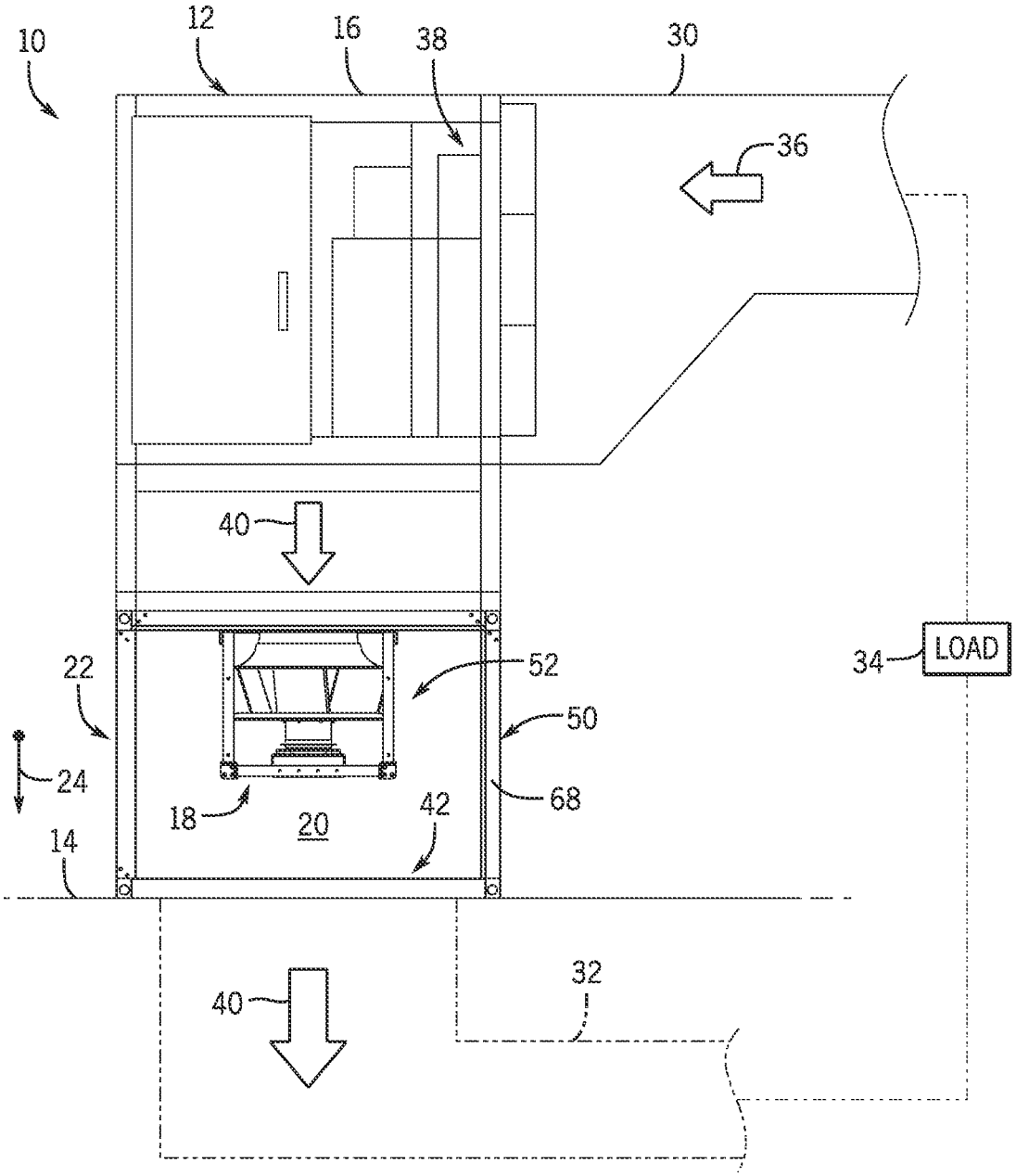
FIG. 1 is a side view of an embodiment of a portion of a heating, ventilation, and/or air conditioning (HVAC) system having an HVAC unit and a mounting assembly for a fan of the HVAC unit, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to regulate environmental parameters of a space within a building, home, or other suitable structure. The HVAC system may include an HVAC unit (e.g., an air handling unit) configured to supply conditioned air to the space. As used herein, "conditioned air" may refer to a flow of supply air that has been heated, cooled, and/or filtered by components of the HVAC unit. For example, the HVAC unit may be configured to condition the supply air flow via an evaporator, a furnace, a heating coil, a chiller system, one or more filters, other components, or a combination thereof, and to provide the conditioned air flow (e.g., a heated air flow, a cooled air flow, a dehumidified air flow, a filtered air flow) to the space. In any case, the HVAC unit may be fluidly coupled to the space via an air distribution system, such as a system of ductwork, which extends between the HVAC unit and the space. One or more fans or blowers of the HVAC unit may be operable to direct the conditioned air from the HVAC unit, through the ductwork, and into the space or spaces within the building. However, in other embodiments, the HVAC unit may be configured to discharge the conditioned air into the space (e.g., directly into the conditioned space).

Typically, the one or more fans are positioned within an enclosure or housing of the HVAC unit. In some cases, the enclosure may form at least a portion of a supply air flow path of the HVAC system. For example, the supply air flow path may be fluidly coupled to and/or form a portion of the air distribution system of the HVAC system. As such, the HVAC unit may utilize the air distribution system to provide conditioned air to designated spaces of the building or other structure serviced by the HVAC system in accordance with the aforementioned techniques.

In many cases, it may be difficult to install the fan in the HVAC unit and/or to remove the fan from the HVAC unit due to spatial constraints within and/or surrounding the enclosure. For example, installation of the fan in the HVAC unit may involve a team of service technicians to appropriately position, align, and/or secure the fan within the enclosure of the HVAC unit. Moreover, in many cases, subsequent removal of the fan from the enclosure for maintenance, inspection, or other purposes may involve significant disassembly of portions of the enclosure and/or of other HVAC components that may be positioned adjacent to the fan. As such, installation of the fan into and/or removal of the fan from the enclosure may be arduous and time consuming.

It is presently recognized that facilitating improved installation and removal of the fan from the HVAC unit may reduce a complexity involved in performing inspection, maintenance, or other operations on the fan. Thus, facilitating improved installation and removal of the fan may reduce a time period and cost that may be associated with completion of such tasks. Accordingly, embodiments of the present disclosure are directed toward a mounting assembly for a fan of the HVAC system, where the mounting assembly is configured to facilitate improved installation and removal of the fan from an HVAC unit of the HVAC system.

For example, in some embodiments, the mounting assembly includes a frame configured to couple to the enclosure of the HVAC unit and/or to another suitable support structure positioned within the enclosure. The mounting assembly may include a first guide rail and a second guide rail that are coupled to the frame and positioned on opposing sides of the frame. The first and second guide rails may include respective lips or guide surfaces that extend at an oblique angle (e.g., relative to horizontal) along the frame of the mounting assembly, from a first end portion of the mounting assembly toward a second end portion of the mounting assembly. For example, in some embodiments, the lips may span along an incline that extends upward, with respect to a direction of gravity, from the first end portion to the second end portion of the mounting assembly. The lips may be configured to receive a chassis of the fan (e.g., during installation of the fan within the enclosure of the HVAC unit) and to guide translation of the fan along the guide rails in a first direction, from the first end portion to the second end portion of the mounting assembly. Particularly, while the chassis of the fan translates along the lips in the first direction, the lips may guide the fan toward a mounting panel that may be positioned vertically above (e.g., with respect to a direction of gravity) the guide rails. The frame may include a support rail that is positioned at or near the second end portion of the mounting assembly and is configured to receive an end portion of the chassis. As discussed in detail herein, the mounting assembly may include a lifting assembly or a pivoting assembly (e.g., a retention system) that, upon engagement between the chassis and the support rail, may rotate (e.g., move, pivot) the fan relative to the guide rails to transition the fan from an intermediate configuration on the guide rails to an installed configuration in the HVAC unit. In the installed configuration, the fan may be coupled to the mounting panel of the mounting assembly. In this way, the mounting assembly may facilitate improved installation of the fan on the HVAC unit. Further, as discussed in detail herein, the mounting assembly may facilitate improved removal of the fan from the HVAC unit by enabling translation of the fan along the guide rails in a second direction, opposite the first direction, to transition from the installed configuration on the HVAC unit to a removed configuration, in which the fan may be extracted from or otherwise decoupled from the enclosure of the HVAC unit. These and other features will be described below with reference to the drawings.

Turning now to the drawings, FIG. 1 is a side view of an embodiment of a portion of a heating, ventilation, and/or air conditioning (HVAC) system 10 for environmental management that may employ one or more HVAC units 12. As used herein, an HVAC system may include any number of components configured to enable regulation of parameters related to climate characteristics, such as temperature, humidity, air flow, pressure, air quality, and so forth. For example, an "HVAC system" as used herein may be defined as conventionally understood and as further described herein. Components or parts of an "HVAC system" may include, but are not limited to, all, some of, or individual components, such as a heat exchanger, a heater, an air flow control device, such as a fan, or a flow straightener, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

The HVAC unit 12 may be a single packaged unit containing other equipment, such as a blower, integrated air handler, and/or auxiliary heating unit. In other embodiments, the HVAC unit 12 may be part of a split HVAC system, which includes an outdoor HVAC unit and an indoor HVAC unit, an air handler, or other unit configured to condition and/or direct air flow to a conditioned space. As discussed below, the HVAC unit 12 may include one or more heat exchangers across which an air flow is passed to condition the air flow before the air flow is supplied to a building or other structure. The HVAC unit 12 may provide a variety of heating and/or cooling functions, such as cooling only, heating only, cooling with electric heat, cooling with dehumidification, cooling with gas heat, cooling with a heat pump, or any combination thereof. For example, in certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air flow and a furnace for heating the air flow. Further, the HVAC unit 12 may be configured to filter an air flow substantially without cooling or heating the air flow, for example.

In the illustrated embodiment, the HVAC unit 12 is positioned on a surface 14 (e.g., a floor) of a structure, such as a room within a building, a rooftop, or another suitable space or area. The HVAC unit 12 includes an enclosure 16 (e.g., a housing) that is configured to house various components of the HVAC unit 12. For example, the enclosure 16 may house a fan 18 that is positioned within an interior 20 of the enclosure 16. The fan 18 may be an axial fan, a centrifugal fan, or another suitable type of fan or blower configured to direct a fluid (e.g., air) along the interior 20 in accordance with the techniques discussed herein. In some embodiments, the fan 18 may be positioned in a lower compartment 22 of the enclosure 16 that is positioned adjacent to the surface 14. That is, the fan 18 may be positioned in a lower portion of the enclosure 16, with respect to a direction of gravity 24, and may be positioned vertically below a remaining portion of the enclosure 16. However, in other embodiments, the fan 18 may be positioned within any other suitable portion of the enclosure 16. Indeed, it should be appreciated that the illustrated embodiment of the HVAC unit 12 is intended to facilitate the following discussion, and the disclosed techniques should not be limited to the arrangement and/or layout depicted in FIG. 1.

The HVAC system 10 may include a return air duct 30 and a supply air duct 32 that are fluidly coupled to the interior 20 of the enclosure 16. The return air duct 30 and the supply air duct 32 may facilitate conditioning of a load 34 (e.g., a room or space within a building or other structure) serviced by the HVAC system 10. For example, in some embodiments, the fan 18 may be operable to draw a return air flow 36 from the load 34 via the return air duct 30. The fan 18 may force the return air flow 36 across one or more HVAC components 38 (e.g., heat exchangers, filters) of HVAC unit 12. As such, the HVAC components 38 may condition the return air flow 36 to generate a conditioned air flow, referred to herein as a supply air flow 40. The fan 18 may direct the supply air flow 40 into the supply air duct 32 and back toward the load 34. In this manner, the HVAC unit 12 may facilitate conditioning of the load 34. In some embodiments, the supply air duct 32 may be positioned beneath the surface 14. In such embodiments, the fan 18 may be configured to force the supply air flow 40 from the interior 20 of the enclosure 16, through an opening 42 or grate formed in the surface 14, and into the supply air duct 32. Moreover, in certain embodiments, the return air duct 30 and/or the supply air duct 32 may be omitted, such that the HVAC unit 12 may be fluidly coupled directly to a return air plenum and/or a supply air plenum, for example.

In any case, embodiments of the HVAC unit 12 discussed herein include a mounting assembly 50 that is configured to facilitate improved installation of the fan 18 in the HVAC unit 12 and to facilitate improved removal of the fan 18 from the HVAC unit 12. That is, the mounting assembly 50 may facilitate transition of the fan 18 between an installed configuration 52, in which the fan 18 may be coupled to or otherwise supported within the enclosure 16, and an initial configuration 54 (see FIG. 5), also referred to herein as a removed configuration, in which the fan 18 is fully extracted, partially extracted, and/or otherwise uninstalled from the enclosure 16. In some embodiments, the mounting assembly 50 may form a portion of the enclosure 16. For example, the mounting assembly 50 may form a section of a frame of the enclosure 16 and may include panels coupled thereto that, together with the frame, bound at least a portion of the interior 20 of the enclosure 16. In other embodiments, the mounting assembly 50 may be one or more components that are separate from the enclosure 16 and is positioned within the interior 20 of the enclosure 16.

Figure 2:
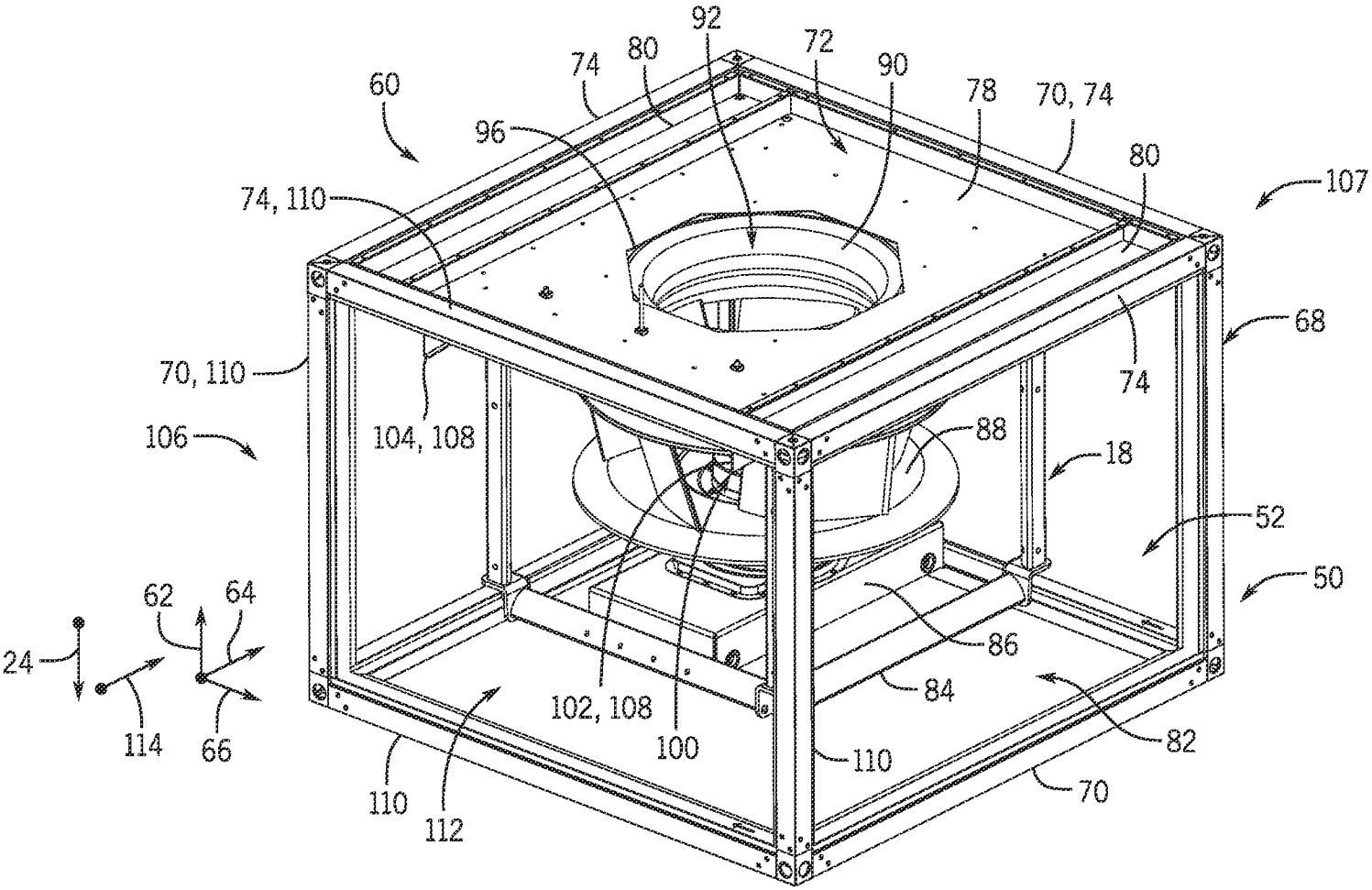
FIG. 2 is a perspective view of an embodiment of a fan assembly having a mounting assembly for mounting a fan in an HVAC unit, in accordance with an aspect of the present disclosure.

To better illustrate the mounting assembly 50 (e.g., a fan segment) and to facilitate the following discussion, FIG. 2 is a perspective view of an embodiment of a fan assembly 60 that includes the fan 18 and the mounting assembly 50. For clarity, the mounting assembly 50 and components thereof may be described with reference to a vertical axis 62, a longitudinal axis 64, and a lateral axis 66. The vertical axis 62 may extend generally along the direction of gravity 24. The longitudinal axis 64 and the lateral axis 66 extend generally radially from (e.g., cross-wise to, horizontal from) the vertical axis 62. For clarity, as used herein, discussion of a first direction, axis, component, surface, and/or feature being "generally" or "substantially" parallel to, aligned with, and/or extending along a reference direction, axis, component, surface, and/or feature may refer to the first direction, axis, component, surface, and/or feature being within a threshold orientation of (e.g., within 1 degree of, within 5 degrees of, within 10 degrees of) the reference direction, axis, component, surface, and/or feature.

The mounting assembly 50 includes a frame 68 that may be coupled to and/or positioned within the enclosure 16. Additionally or alternatively, the frame 68 may form a portion of the enclosure 16. For example, the frame 68 may form or define the lower compartment 22 of the enclosure 16. In some embodiments, the frame 68 may be formed from a plurality of beams 70 (e.g., tubular bars, support rails, or structures) that are coupled to one another via fasteners, adhesives, and/or a metallurgical process, such as welding or brazing. The mounting assembly 50 also includes a mounting panel 72 that may be coupled to a first subset 74 of the beams 70. As discussed below, the mounting panel 72 may be configured to support some of or all of a weight of the fan 18 in the installed configuration 52 of the fan 18. In the illustrated embodiment, the mounting panel 72 includes a primary support panel 78 and a set of secondary support panels 80 that may collectively form the mounting panel 72. As discussed below, in other embodiments, the secondary support panels 80 may be omitted from the mounting assembly 50. The mounting panel 72 may also be referred to herein as a frame of the mounting assembly 50. That is, it should be understood that that mounting panel 72 may form and be referred to herein as a portion of the frame 68. Moreover, the frame 68 may include any suitable section, component, and/or other structure of the HVAC unit 12. In some embodiments, the beams 70 of the frame 68 may be omitted, such that the mounting panel 72 may form substantially all of the frame 68 of the mounting assembly 50. As such, the mounting panel 72 may be coupled to a suitable section, component, and/or other structure of the HVAC unit 12 to facilitate operation of the mounting assembly 50 in accordance with the techniques discussed herein.

In any case, in the illustrated embodiment, the fan 18 is in the installed configuration 52, in which the fan 18 is positioned within an interior region 82 (e.g., an interior volume) of the frame 68. The interior region 82 may be bound by (e.g., encompassed by) the beams 70. As discussed in detail herein, in the installed configuration 52, the fan 18 may be coupled to and/or supported by the mounting panel 72. That is, in the installed configuration 52, the fan 18 may be coupled to or otherwise supported by (e.g., partially supported by, fully supported by) the primary support panel 78, the secondary support panels 80, or both.

The fan 18 may include a chassis 84 that is configured support components of the fan 18. For example, the chassis 84 may be configured to support a motor 86 of the fan 18 and a rotor 88 of the fan 18. The chassis 84 includes a shroud 90 (e.g., an intake shroud) having a passage 92 configured to guide an air flow toward the rotor 88 during operation of the fan 18. In the installed configuration 52 of the fan 18, the passage 92 may be aligned with an opening 96 formed in the mounting panel 72. That is, a channel or venturi orifice formed by the passage 92 may be aligned generally concentrically with a center of the opening 96 in the installed configuration 52 of the fan 18. As such, during operation of the fan 18, the rotor 88 may draw an air flow through the opening 96, through the passage 92, and may exhaust the air flow into the interior region 82 of the frame 68. Although the opening 96 is illustrated as a generally octagonal aperture in the illustrated embodiment of FIG. 2, it should be appreciated that, in other embodiments, the opening 96 may have any other suitable cross-sectional geometry. As non-limiting examples, the opening 96 may include a circular geometry, a quadrilateral geometry, or a hexagonal geometry.

As discussed in detail herein, the mounting assembly 50 includes a railing assembly 100 that is configured to engage with the fan 18 and to facilitate insertion of and removal of the fan 18 from the interior region 82 of the frame 68. That is, the railing assembly 100 facilitates transition of the fan 18 from the initial configuration 54, also referred to herein as a removed configuration, to the installed configuration 52, and vice versa. The railing assembly 100 may be coupled to the mounting panel 72, the frame 68, or both. As described further below with reference to FIG. 3, the railing assembly 100 may include a first guide rail 102 and a second guide rail 104 that may extend from a first end 106 of the frame 68 toward a second end 107 of the frame 68. The first and second guide rails 102, 104 may be collectively be referred to herein as guide rails 108.

The first end 106 of the frame 68 may include a second subset 110 of beams 70, which may collectively define the first end 106 of the frame 68. In some embodiments, the second subset 110 of the beams 70 define a receiving opening 112 or receiving channel of the frame 68. As discussed below, the guide rails 108 are configured to receive and engage with the chassis 84 of the fan 18 to facilitate movement of the fan 18 through the receiving opening 112, in a first direction 114 along the longitudinal axis 64, and toward the second end 107 of the frame 68. In this way, the guide rails 108 may facilitate transition of the fan 18 from the initial configuration 54 to the installed configuration 52, for example.

Figure 3:
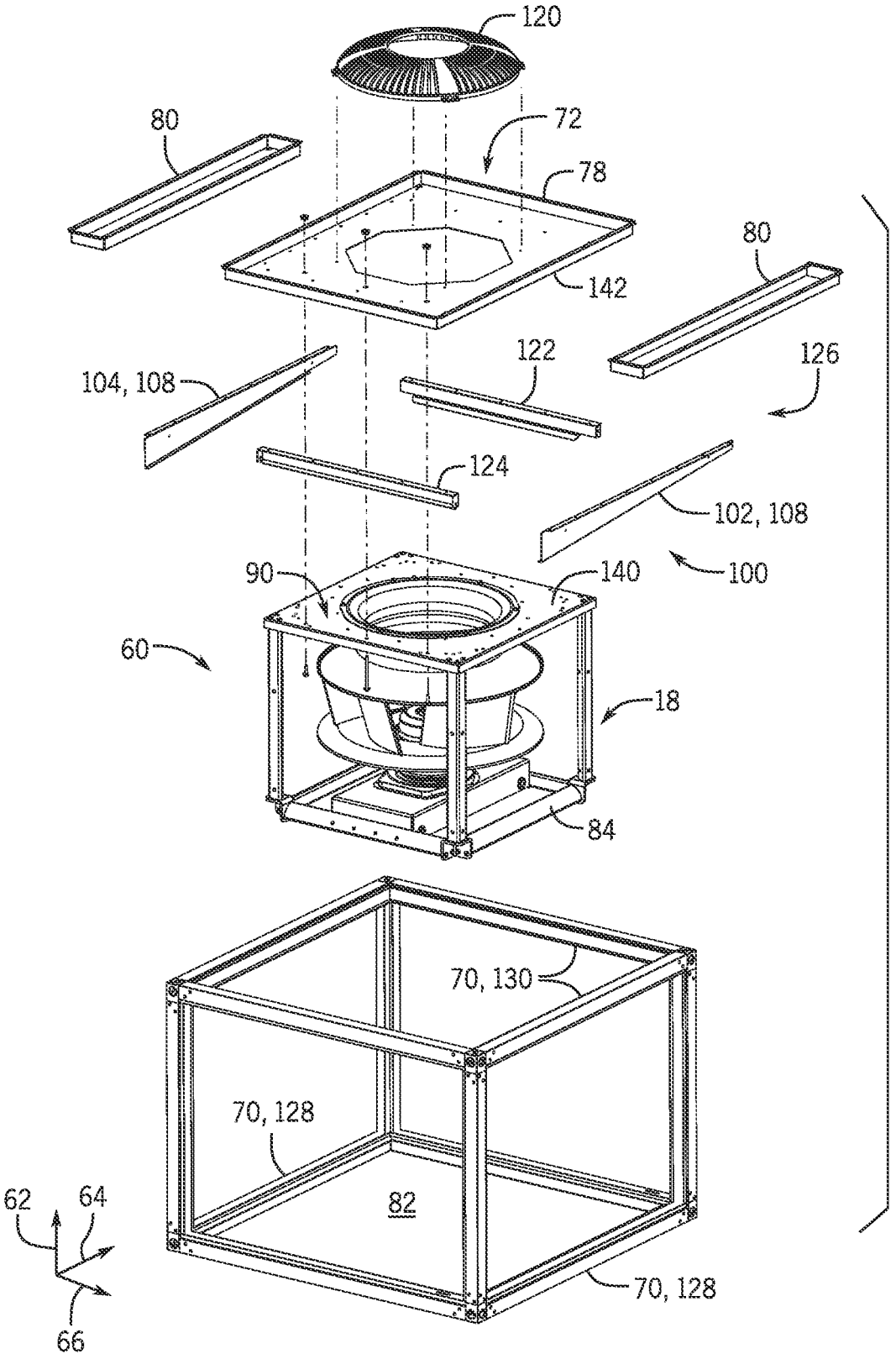
FIG. 3 is an exploded perspective view of an embodiment of a fan assembly having a mounting assembly for mounting a fan in an HVAC unit, in accordance with an aspect of the present disclosure.

FIG. 3 is an exploded perspective view of an embodiment of the fan assembly 60. As discussed above, the mounting panel 72 may include the primary support panel 78 and the set of secondary support panels 80. In some embodiments, in an assembled configuration of the mounting assembly 50, the set of secondary support panels 80 may be coupled to opposing sides of the primary support panel 78. The mounting assembly 50 may include a fan guard 120 that is configured to couple to the primary support panel 78, for example. In some embodiments, the fan guard 120 may be configured to guide ingress of air flow toward the rotor 88 of the fan 18. For example, the fan guard 120 may include fins or ribs configured to facilitate ingress of laminar air flow through the opening 96 and toward the rotor 88. In some embodiments, the fan guard 120 may be omitted from the mounting assembly 50.

In the illustrated embodiment, the railing assembly 100 includes the first guide rail 102 and the second guide rail 104 mentioned above, as well as a support rail 122 and an abutment rail 124. The mounting panel 72 and the railing assembly 100 may collectively be referred to herein as a fan support 126. In the assembled configuration of the mounting assembly 50, the first guide rail 102, the second guide rail 104, the support rail 122, and the abutment rail 124 may be coupled to one another, to the mounting panel 72, and/or to the frame 68 via fasteners, adhesives, and/or a metallurgical process, such as welding or brazing. In some embodiments, in the assembled configuration of the mounting assembly 50, the first and second guide rails 102, 104 may extend generally parallel to one another and/or may extend generally parallel to respective beams 128 (e.g., a set of opposing beams 70) of the frame 68. Moreover, in the assembled configuration of the mounting assembly 50, the support rail 122 and the abutment rail 124 may extend generally parallel to one another and to respective beams 130 (e.g., a set of opposing beams 70) of the frame 68. As such, it should be understood that, in the assembled configuration of the mounting assembly 50, the guide rails 108 and the beams 128 may extend generally parallel to the longitudinal axis 64 and the support rail 122, the abutment rail 124, and the beams 130 may extend generally parallel to the lateral axis 66.

As discussed below, the shroud 90 of the chassis 84 may be configured to engage with or otherwise couple to the mounting panel 72 in the installed configuration 52 of the fan 18. For example, the shroud 90 may include a first receiving surface 140 that is configured to couple to and/or engage with a second receiving surface 142 of the mounting panel 72 in the installed configuration 52 of the fan 18. In other embodiments, the first receiving surface 140 may be disposed adjacent to and/or may face the second receiving surface 142 in the installed configuration 52. As discussed above, in some embodiments, the beams 70 of the frame 68 may be omitted from the mounting assembly 50. Indeed, it should be appreciated that the fan support 126, including the mounting panel 72, may be suitable to enable transitioning of the fan 18 from the initial configuration 54 to the installed configuration 52, and vice versa, in accordance with the techniques discussed herein. That is, the fan support 126 may be coupled to a suitable component of the HVAC unit 12 and/or to another component of the HVAC system 10 to facilitate transitioning of the fan 18 between the initial configuration 54 and the installed configuration 52, for example. Accordingly, in such embodiments, the fan support 126 may form substantially all of the mounting assembly 50.

Figure 4:
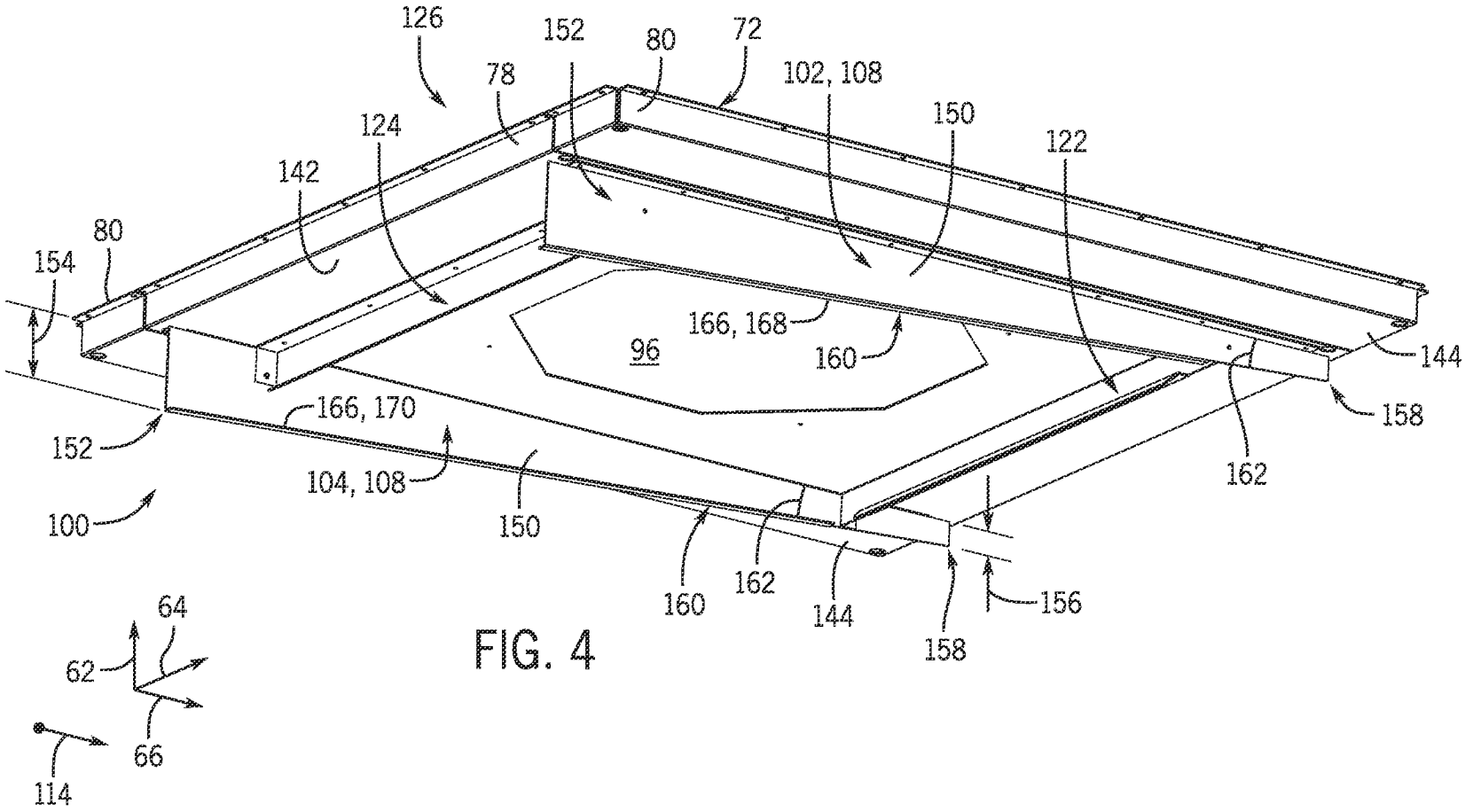
FIG. 4 is a perspective view of an embodiment of a fan support for a mounting assembly of a fan of an HVAC unit, in accordance with an aspect of the present disclosure.

FIG. 4 is a perspective view of an embodiment of the fan support 126. As shown in the illustrated embodiment, the first guide rail 102 and the second guide rail 104 are coupled to surfaces 144 of the secondary support panels 80. The surfaces 144 of the secondary support panels 80 may form a portion of the second receiving surface 142 of the mounting panel 72. In other embodiments, the guide rails 108 may be coupled to a surface of the primary support panel 78. In any case, as shown in the illustrated embodiment, the guide rails 108 include respective side panels 150 that, in an installed configuration of the guide rails 108 on the mounting panel 72, may extend generally cross-wise to (e.g., orthogonal to) the second receiving surface 142.

As shown in the illustrated embodiment of FIG. 4, a first end portion 152 of the guide rails 108 may include a first height 154 (e.g., a dimension along the vertical axis 62) that exceeds a second height 156 (e.g., a dimension along the vertical axis 62) of a second end portion 158 of the guide rails 108. As such, respective distal ends 160 (e.g., distal edges) of the side panels 150 may converge toward the mounting panel 72 in the first direction 114 along the longitudinal axis 64. In other words, the distal ends 160 may extend along an incline relative to the second receiving surface 142 and in the first direction 114. In some embodiments, respective angles 162 (e.g., oblique angles) formed between the second receiving surface 142 and the distal ends 160 may be between about 3 degrees and about 45 degrees. The angles 162 may be substantially equal to one another (e.g., within 2 degrees of one another).

Each of the guide rails 108 may include a lip 166 (e.g., a guide surface) that extends from the corresponding distal end 160 and extends generally cross-wise to a corresponding side panel 150 of the guide rails 108. That is, a first lip 168 (e.g., a first guide surface) of the first guide rail 102 may extend from the distal end 160 of the first guide rail 102 generally along the lateral axis 66 and toward the second guide rail 104. A second lip 170 (e.g., a second guide surface) of the second guide rail 104 may extend from the distal end 160 of the second guide rail 104 generally along the lateral axis 66 and toward the first guide rail 102. As such, the first and second lips 168, 170 may extend from the guide rails 108 toward one another. In this way, the first and second lips 168, 170 may form a channel between the guide rails 108 that, as discussed below, is configured to receive the shroud 90 of the fan 18.

Each of the lips 166 may extend from the first end portion 152 of the corresponding guide rail 108 to the second end portion 158 of the corresponding guide rail 108. In some embodiments, the lip 166 of each guide rail 108 may extend continuously from the first end portion 152 toward the second end portion 158. In other embodiments, each of the guide rails 108 may include a plurality of separate or spaced apart lips that extend between the first and second end portions 152, 158. Although the lips 166 are shown as extending from respective distal ends 160 of the side panels 150 in the illustrated embodiment of FIG. 4, it should be appreciated that, in other embodiments, the lips 166 may extend from respective surfaces (e.g., inner surfaces) of the side panels 150 that are between the distal ends 160 and the second receiving surface 142. Accordingly, in such embodiments, the lips 166 may be offset from the distal ends 160. In any case, as discussed below, the lips 166 are configured to receive and engage with the chassis 84 of the fan 18 and to guide translational movement of the fan 18 along the guide rails 108 from the first end portion 152 of the guide rails 108 toward the second end portion 158 of the guide rails 108, and vice versa.

In some embodiments, the support rail 122 may be coupled to the primary support panel 78, the secondary support panels 80, the guide rails 108, or a combination thereof. Similar to the support rail 122, the abutment rail 124 may be coupled to the primary support panel 78, the secondary support panels 80, the guide rails 108, or a combination thereof. The support rail 122 and the abutment rail 124 may extend between the first and second guide rails 102, 104 and may extend generally parallel to the lateral axis 66. As such, the support rail 122 and the abutment rail 124 may extend generally parallel to one another and generally orthogonal to respective lengths (e.g., dimensions extending between the first end portion 152 and the second end portion 158) of the guide rails 108. As discussed in detail below, the support rail 122 and/or the abutment rail 124 may facilitate transition of the fan 18 toward the installed configuration 52 in accordance the disclosed techniques.

Figure 5:
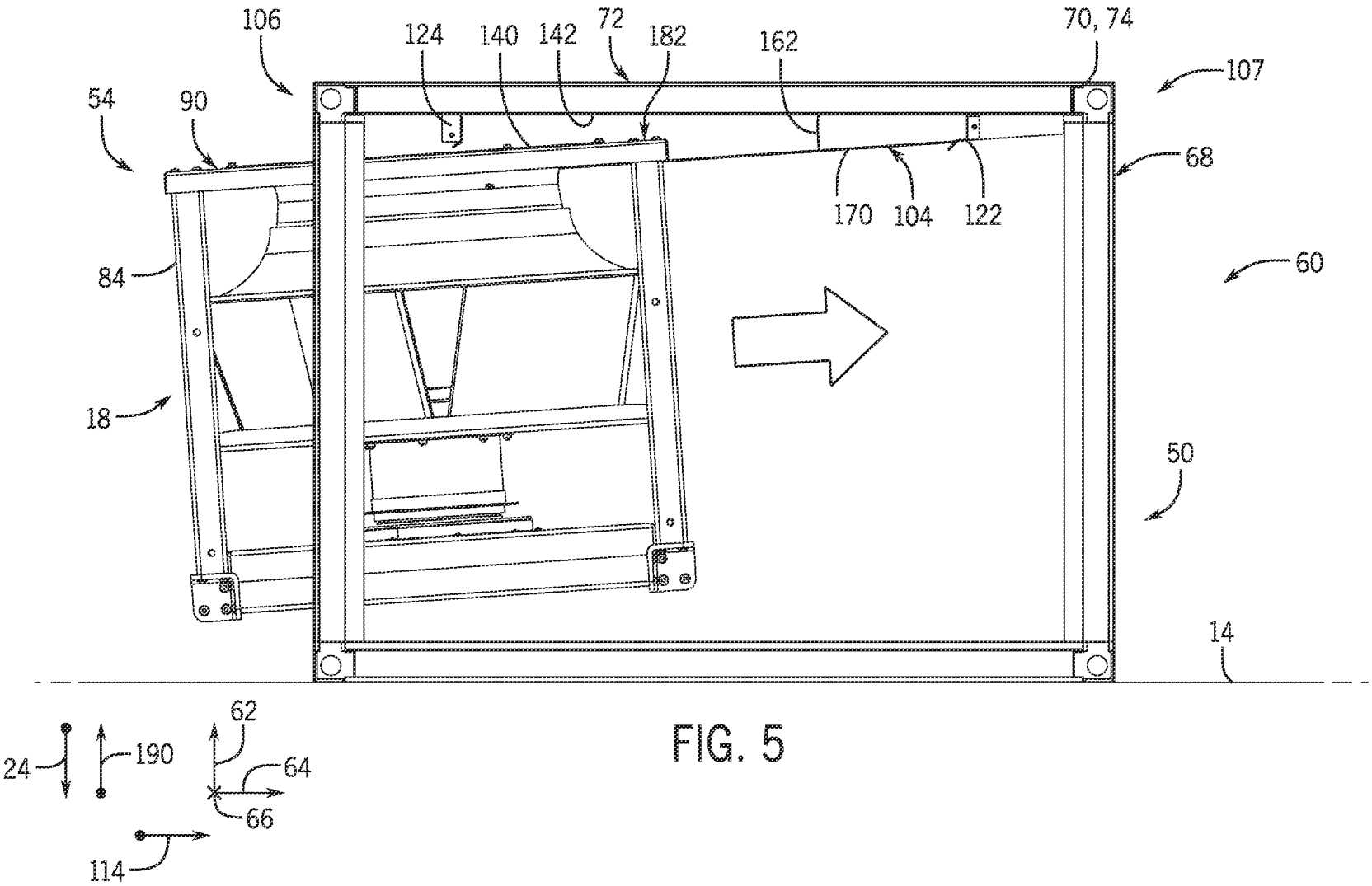
FIG. 5 is a side view of an embodiment of a portion of a fan assembly, illustrating a fan positioned in an initial configuration on a mounting assembly, in accordance with an aspect of the present disclosure.
Figure 6:
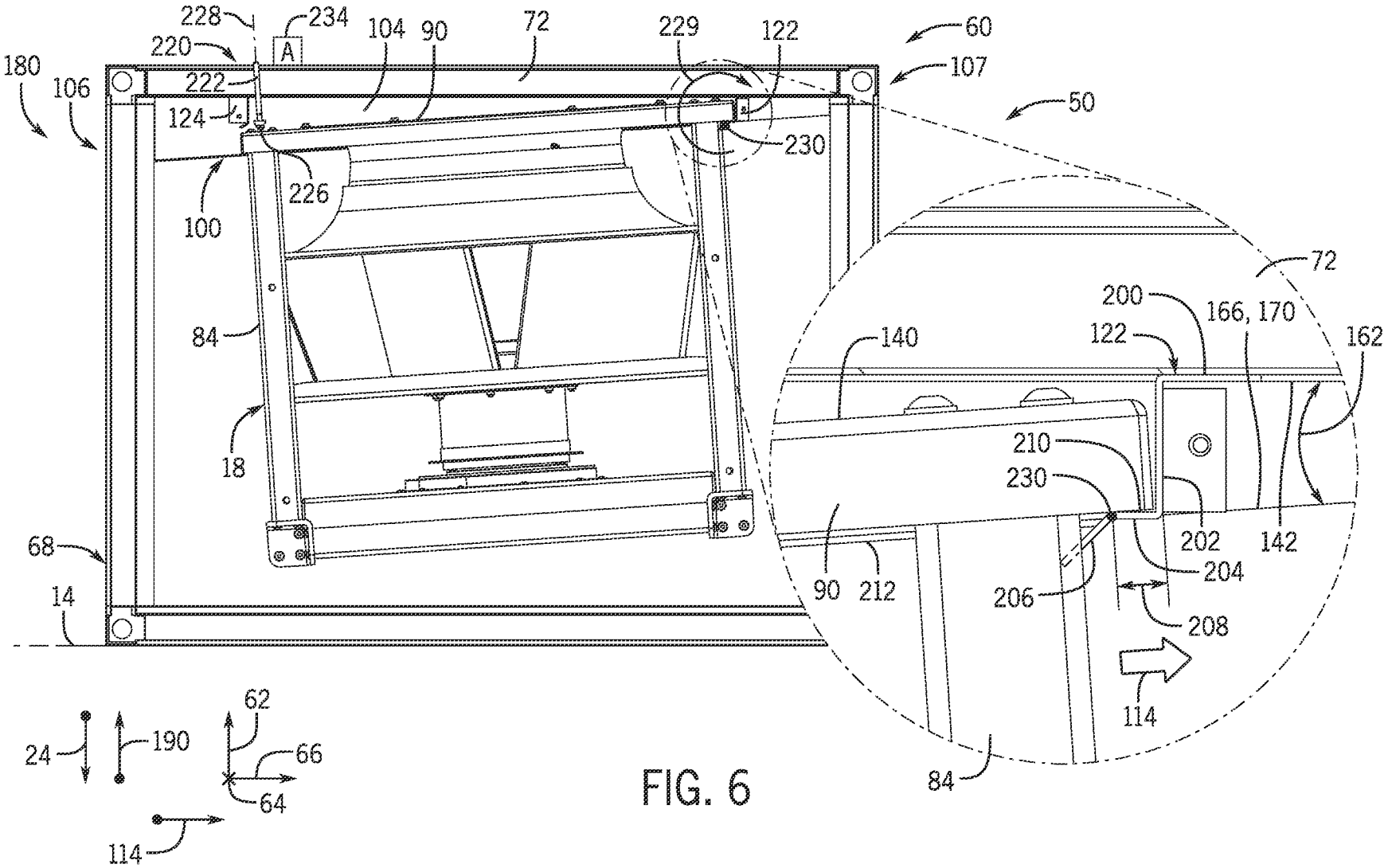
FIG. 6 is a side view of an embodiment of a portion of a fan assembly, illustrating a fan positioned in an intermediate configuration on a mounting assembly, in accordance with an aspect of the present disclosure.
Figure 7:
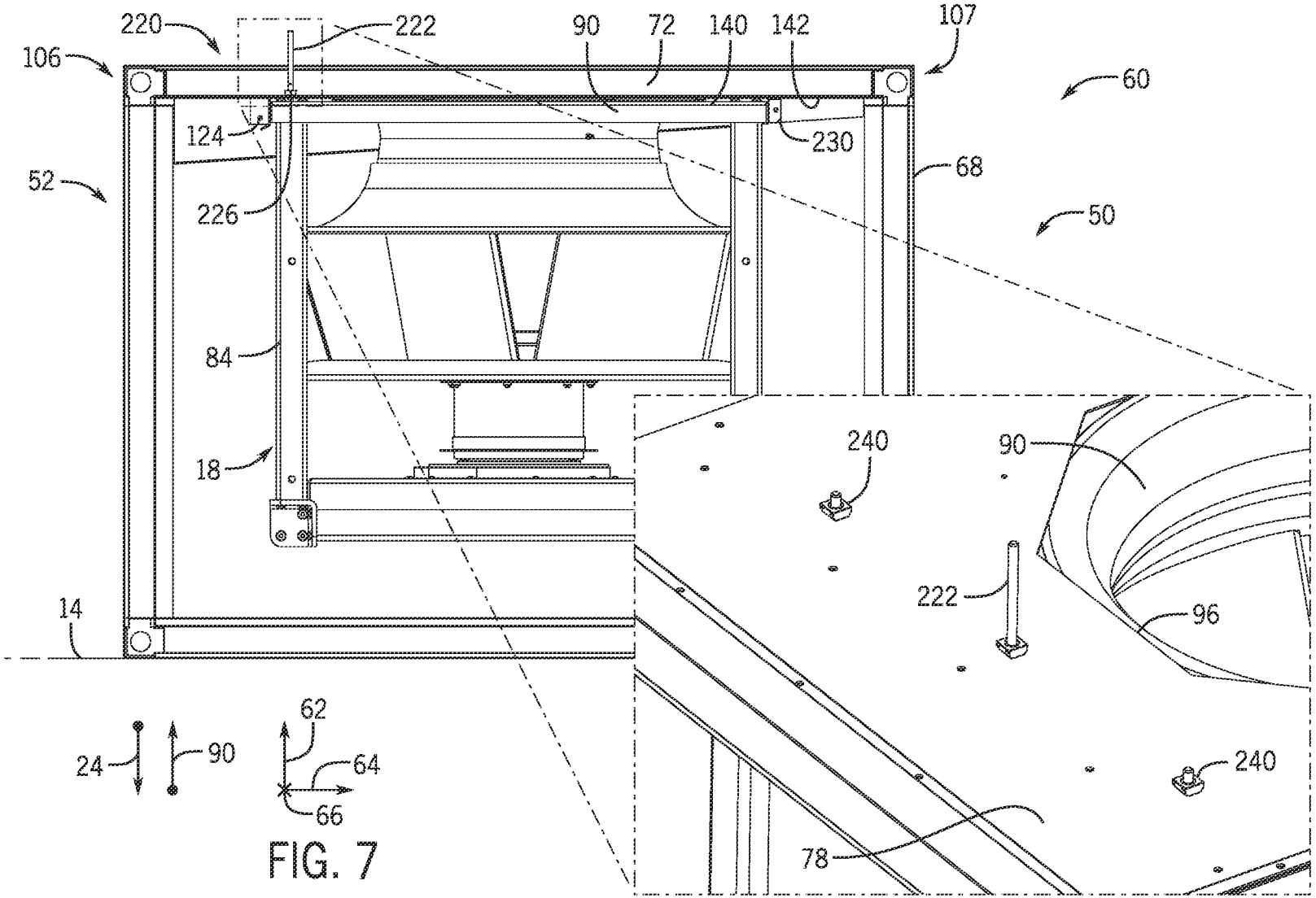
FIG. 7 is a side view of an embodiment of a portion of a fan assembly, illustrating a fan positioned in an installed configuration on a mounting assembly, in accordance with an aspect of the present disclosure.

FIG. 5 is a side view of an embodiment of a portion of the fan assembly 60 (e.g., a fan segment), illustrating the fan 18 positioned in the initial configuration 54 with the mounting assembly 50. FIG. 6 is a side view of an embodiment of a portion of the fan assembly 60, illustrating the fan 18 positioned in an intermediate configuration 180, also referred to herein as a resting configuration, with the mounting assembly 50. Further, FIG. 7 is a side view of an embodiment of a portion of the fan assembly 60, illustrating the fan 18 positioned in the installed configuration 52 with the mounting assembly 50. For clarity, it should be understood that the first guide rail 102 is hidden in the illustrated embodiments of FIGS. 5, 6, and 7 to better illustrate the features and operation of the mounting assembly 50 discussed below. However, it should be understood that the first guide rail 102 may engage with and interact with the fan 18 in a manner that is substantially similar to or identical to the engagement and interaction between the fan 18 and the second guide rail 104 discussed herein.

Figure 8:
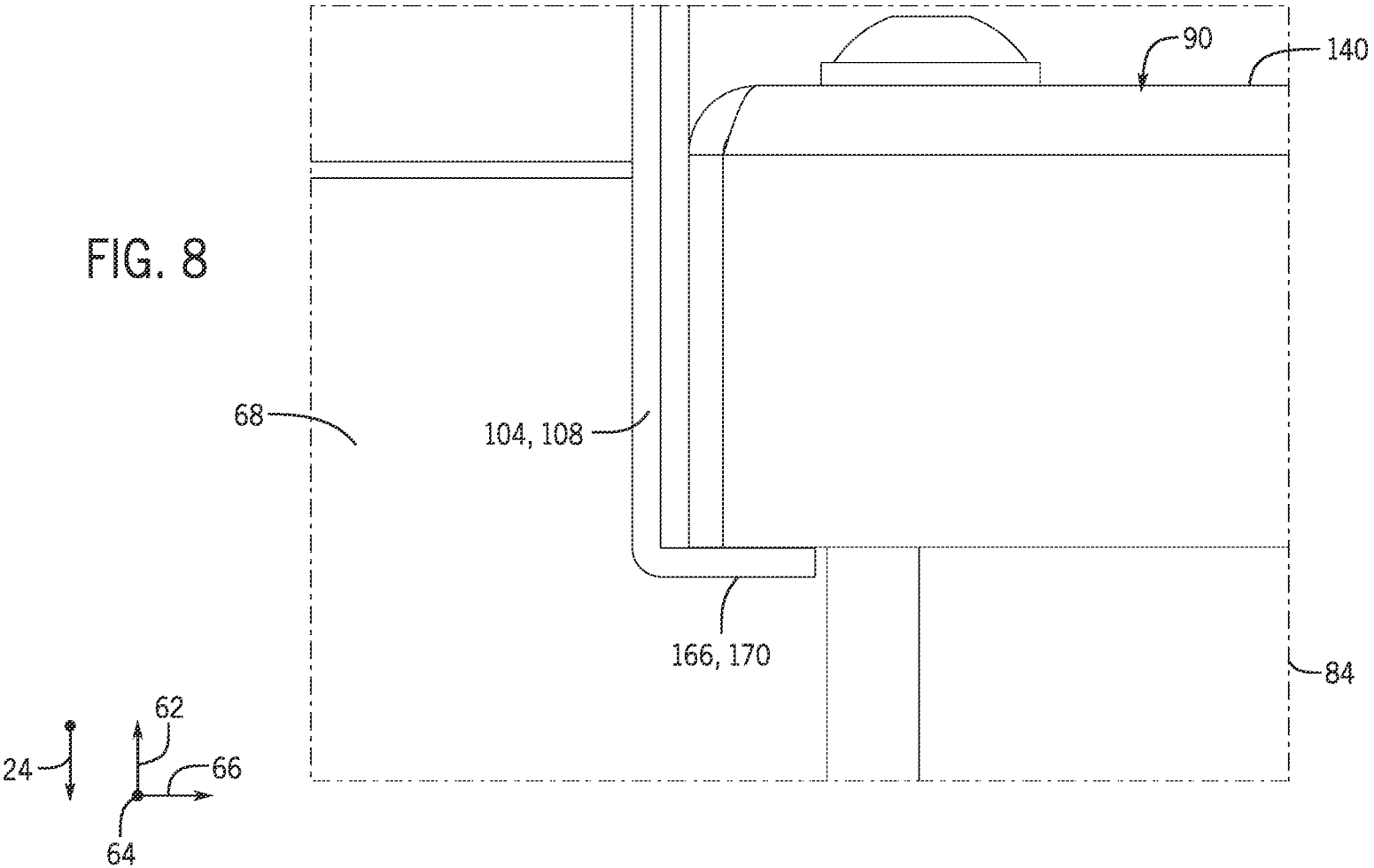
FIG. 8 is a cross-sectional side view of an embodiment of a portion of a fan assembly, illustrating a fan positioned in an intermediate configuration on a mounting assembly, in accordance with an aspect of the present disclosure.

The following discussion continues with reference to FIG. 5. In the illustrated embodiment of FIG. 5, the frame 68 is positioned on the surface 14, such that the first subset 74 of the beams 70 may extend generally cross-wise to the direction of gravity 24 and generally parallel to the surface 14. In order to transition the fan 18 from the initial configuration 54 to the installed configuration 52, a user (e.g., a service technician) may first position a first portion 182 (e.g., a first end) of the chassis 84 on the lips 166 of the guide rails 108. For example, the user may, when the fan 18 is removed from the frame 68, manually or with the assistance of tools (e.g., a crane or lift) insert the fan 18 into the receiving opening 112 and position the chassis 84 such that at least a portion of the chassis 84 (e.g., the first portion 182, the shroud 90) engages with and rests on (e.g., is supported by) the lips 166. To better illustrate the engagement between the chassis 84 and the second guide rail 104, FIG. 8 is a cross-sectional view of an embodiment of a portion of the mounting assembly 50, illustrating the shroud 90 of the chassis 84 engaged with (e.g., physically contacting) the second lip 170 of the second guide rail 104.

Returning again to FIG. 5, upon engaging the chassis 84 with the lips 166, the user may apply a force to the chassis 84 in the first direction 114 to guide translation of the fan 18 (e.g., the shroud 90) along the lips 166 and from the first end 106 of the frame 68 toward the second end 107 of the frame 68. It should be appreciated that, because the lips 166 extend at the angle 162 (e.g., relative to the second receiving surface 142), the lips 166 may guide translation of the fan 18 in an upward direction 190 (e.g., opposite the direction of gravity 24), toward the mounting panel 72, while the fan 18 translates along the guide rails 108 in the first direction 114.

The following discussion continues with reference to FIG. 6. As shown in the illustrated embodiment, the support rail 122 may include a base 200, a web 202 (e.g., an extension), a flange 204, and a tongue 206. The base 200 may be coupled to (e.g., mounted to, secured to) the mounting panel 72. The web 202 extends from the base 200 (e.g., in the direction of gravity 24), and the flange 204 extends from the web 202. The flange 204 may include a length 208 that extends generally cross-wise (e.g., orthogonal) to the direction of gravity 24 (e.g., when the mounting assembly 50 is positioned on the surface 14) and generally parallel to the second receiving surface 142 of the mounting panel 72. As such, the flange 204 may extend at an oblique angle relative to the lips 166 of the guide rails 108. That is, the lips 166 may extend at an oblique angle relative to an extension direction of the length 208 of the flange 204. The tongue 206 may extend from a distal end of the flange 204 at an additional oblique angle relative to the second receiving surface 142 and the flange 204. In some embodiments, a magnitude of the additional oblique angle may exceed a value of the angle 162 between the lips 166 and the second receiving surface 142.

The railing assembly 100 enables the fan 18 to translate along the guide rails 108 in the first direction 114 until the chassis 84 engages with (e.g., abuts) the web 202, for example. In some embodiments, the tongue 206 may be configured to receive the shroud 90 prior to engagement of the shroud 90 with the web 202. As such, the tongue 206 may guide translation of the shroud 90 onto the flange 204 while the shroud 90 translates along guide rails 108 the first direction 114. That is, the tongue 206 may facilitate translation of the shroud 90 onto a surface 210 (e.g., a receiving surface) of the flange 204, such that a surface 212 (e.g., a receiving surface) of the shroud 90 rests on the surface 210 of the flange 204. As such, it should be appreciated that, in the intermediate configuration 180 of the fan 18, the shroud 90 of the fan 18 may be oriented generally parallel to the lips 166 and oblique to the second receiving surface 142 of the mounting panel 72. That is, the first receiving surface 140 of the shroud 90 may be oriented offset from the second receiving surface 142 of the mounting panel 72 at the angle 162 in the intermediate configuration 180 of the fan 18.

In some embodiments, the mounting assembly 50 includes a pivoting assembly 220 (e.g., a raising assembly, a lifting assembly) that facilitates transition of the fan 18 from the intermediate configuration 180 to the installed configuration 52. For example, in certain embodiments, the pivoting assembly 220 includes a threaded rod 222 (e.g., a fastener) that is configured to engage with a portion of the frame 68, such as the primary support panel 78 and with a corresponding threaded portion 226 formed in the shroud 90 or in a component (e.g., a nut) coupled to the shroud 90. That is, in the intermediate configuration 180 of the fan 18, the support rail 122 may position the shroud 90 such that the threaded rod 222 may engage with the frame 68 and the threaded portion 226.

In some embodiments, a user of the mounting assembly 50 may utilize tools (e.g. power tools, hand tools) to rotate the threaded rod 222 about an axis 228 of the threaded rod 222, such that engagement between threads of the threaded rod 222 and corresponding threads of the threaded portion 226 imparts a force on the fan 18 that enables pivoting of the fan 18 in a clockwise direction 229 about a pivoting point 230, also referred to herein as a pivoting axis. The pivoting point 230 may be located at an area of engagement (e.g., physical contact) between the shroud 90 and the support rail 122 and/or between the shroud 90 and the lips 166. As such, the pivoting assembly 220 may be operable to transition the fan 18 from the intermediate configuration 180 toward the installed configuration 52.

Although the pivoting assembly 220 is described above as having a threaded rod 222 for facilitating transition of the fan 18 from the intermediate configuration 180 to the installed configuration 52, it should be appreciated that, in other embodiments, the pivoting assembly 220 may include any other suitable mechanism, device, or component in addition to, or in lieu of, the threaded rod 222, that is suitable for transitioning the fan 18 from the intermediate configuration 180 to the installed configuration 52, and vice versa, in accordance with the aforementioned techniques. For example, in some embodiments, the pivoting assembly 220 may include a winch having a chain or cable that may be coupled to the shroud 90. As such, the chain or cable may subsequently be spooled or unspooled from a drum of the winch to facilitate pivoting the fan 18 about the pivoting point 230 and between the intermediate configuration 180 and the installed configuration 52, for example. Additionally or alternatively, the pivoting assembly 220 may include one or more actuators 234, such as hydraulic actuators, linear actuators, and/or pneumatic actuators, which may be configured to facilitate transition of the fan 18 between the intermediate configuration 180 and the installed configuration 52. For example, the one or more actuators 234 may drive operation of the pivoting assembly 220 (e.g., drive the threaded rod 222) to transition the fan 18 between the intermediate configuration 180 and the installed configuration 52, and vice versa. Indeed, it should be appreciated that various embodiments of the pivoting assembly 220 are envisioned within the scope of the present disclosure.

The following discussion continues with reference to FIG. 7. As shown in the illustrated embodiment of FIG. 7, in the installed configuration 52 of the fan 18, the first receiving surface 140 of the shroud 90 may substantially abut the second receiving surface 142 of the mounting panel 72. In some embodiments, support rail 122 and the pivoting assembly 220 may cooperate such that, in the installed configuration 52 of the fan 18, the first receiving surface 140 of the shroud 90 is biased against the second receiving surface 142 of the mounting panel 72. In certain embodiments, a gasket may be positioned between the first and second receiving surfaces 140, 142 to facilitate formation of a fluidic seal between the first receiving surface 140 and the second receiving surface 142 in the installed configuration 52 of the fan 18. However, in other embodiments, the first and second receiving surfaces 140, 142 may be offset from one another in the installed configuration 52.

In some embodiments, the mounting assembly 50 may include one or more fasteners 240 that are installed near the first end 106 of the frame 68 and configured to engage with the fan 18 in the installed configuration 52 in addition to, or in lieu of, the threaded rod 222 of the pivoting assembly 220. That is, the fasteners 240 may facilitate securement of the shroud 90 to the mounting panel 72 in the installed configuration 52 of the fan 18. The one or more fasteners 240 and the pivoting assembly 220 may individually or collectively form a retention system of the mounting assembly 50, where the retention system is configured to secure the fan 18 in the installed configuration 52 or orientation within the interior region 82 of the frame 68. In some embodiments, the support rail 122 may be sized to support the fan 18 near the second end 107 of the frame 68. As such, the support rail 122 may facilitate retention of the fan 18 in the installed configuration 52 without usage of fasteners positioned near the second end 107 of the frame 68. However, in other embodiments, dedicated fasteners may be used to couple the shroud 90 to the mounting panel 72 near the second end portion 108 of the frame 68. In any case, in the installed configuration 52, the fan 18 may be supported by the frame 68 such that the fan 18 is suspended above the surface 14, for example. It should be appreciated that the fan 18 may be transitioned from the installed configuration 52 to the initial configuration 54 by performing the aforementioned steps in reverse order.

Figure 9:
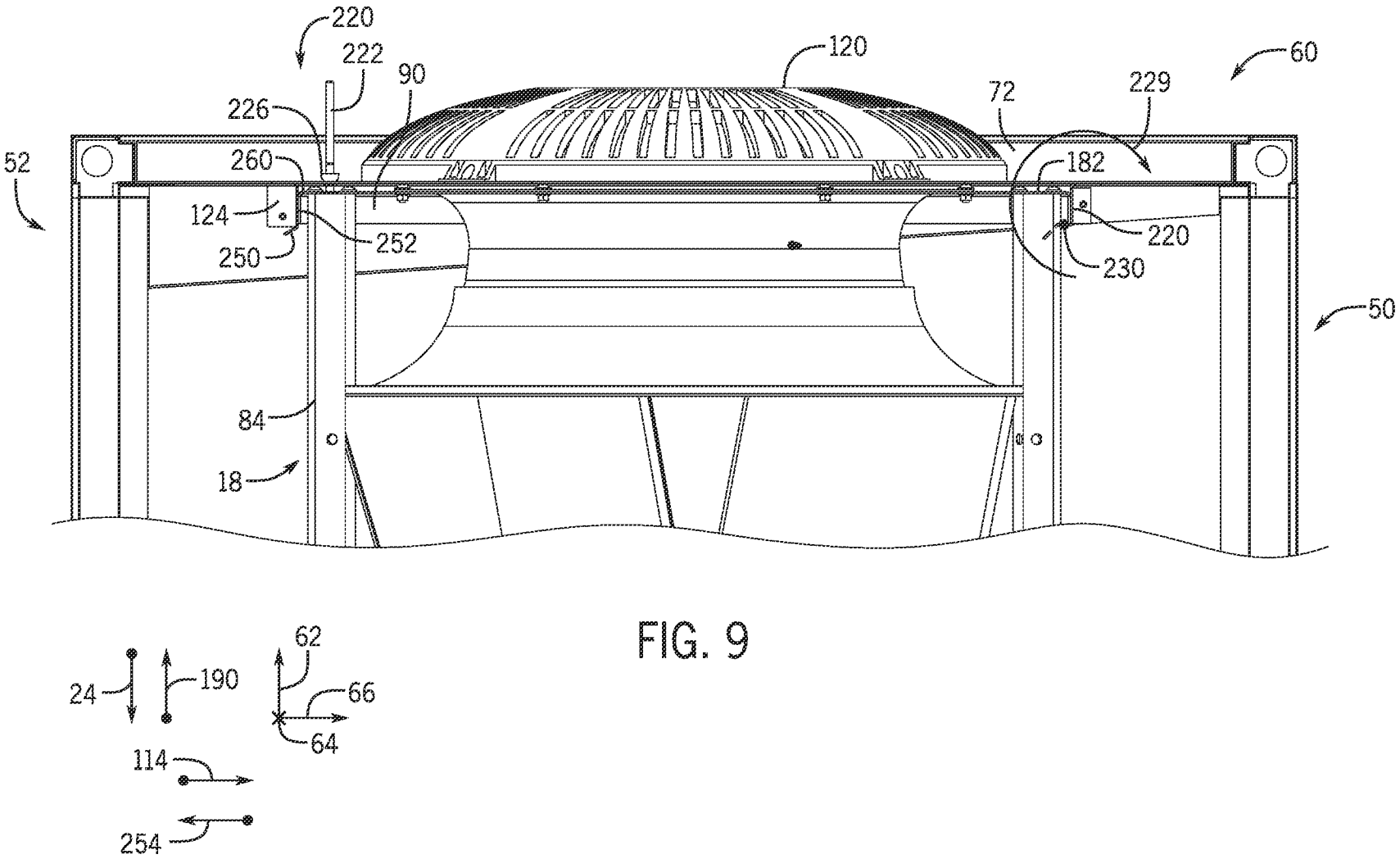
FIG. 9 is a side view of an embodiment of a portion of a fan assembly, illustrating a fan positioned in an installed configuration on a mounting assembly, in accordance with an aspect of the present disclosure.

FIG. 9 is a side view of an embodiment of a portion of the fan assembly 60, illustrating the fan 18 positioned in the installed configuration 52 with the mounting assembly 50. For clarity, it should be understood that the first guide rail 102 is hidden in the illustrated embodiment of FIG. 9 to better illustrate certain features of the mounting assembly 50 discussed herein. In some embodiments, the abutment rail 124 includes an additional tongue 250 that extends from an abutment surface 252 of the abutment rail 124 at least partially in a second direction 254, opposite to the first direction 114. In some embodiments, the additional tongue 250 may engage with and/or guide movement of a second portion 260 of the shroud 90 (e.g., a portion of the shroud 90 opposite the first portion 182 of the shroud 90) as the pivoting assembly 220 transitions the fan 18 from the intermediate configuration 180 to the installed configuration 52. Furthermore, as the threaded rod 222 engages with the shroud 90 to rotate the fan 18 in the clockwise direction 229 about the pivoting point 230, the additional tongue 250 may engage (e.g., contact) the shroud 90 to drive the shroud 90 in the first direction 114 and press the shroud 90 against the web 202 of the support rail 122. As such, the additional tongue 250 may facilitate positioning of the shroud 90 between the abutment surface 252 and the web 202 during transition of the fan 18 from the intermediate configuration 180 to the installed configuration 52. In some embodiments, the pivoting assembly 220 and the support rail 122 may be configured to support all of or substantially all of a weight of the fan 18 in the installed configuration 52. As such, the fan 18 may not rest on, for example, the lips 166 of the guide rails 108 in the installed configuration 52.

Figure 10:
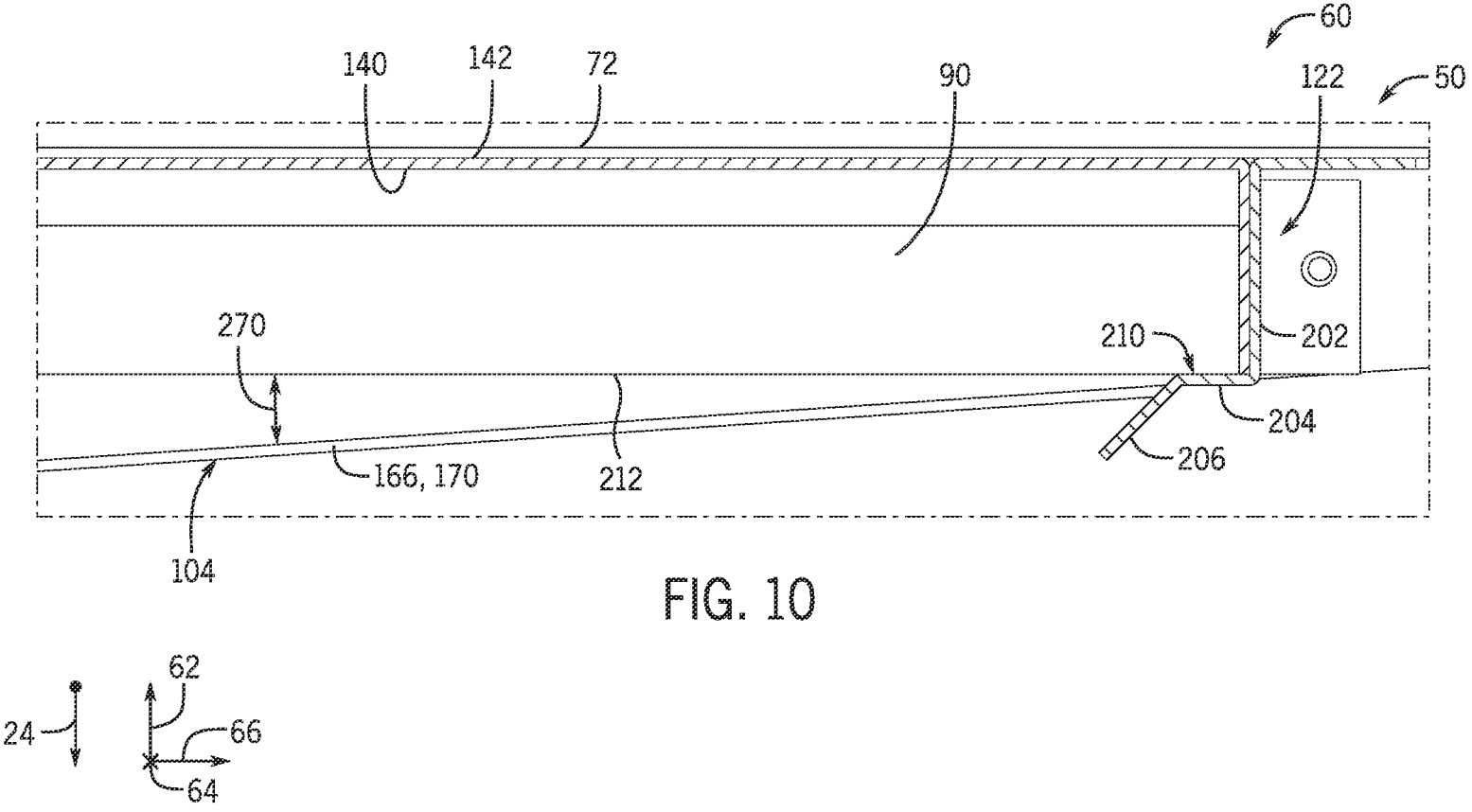
FIG. 10 is a side view of an embodiment of a portion of a fan assembly, illustrating a shroud of a fan positioned in an installed configuration on a mounting assembly, in accordance with an aspect of the present disclosure.

To better illustrate the position of the fan 18 in the installed configuration 52 and to facilitate the following discussion, FIG. 10 is a side view of an embodiment of a portion of the mounting assembly 50. In the illustrated embodiment, the first guide rail 102 and a portion of the chassis 84 of the fan 18 have been removed to better illustrate features of the support rail 122. In some embodiments, the surface 210 of the flange 204 of the support rail 122 may be positioned above (e.g., with respect to the direction of gravity 24) the lips 166 of the guide rails 108. As such, when transitioning the fan 18 from the intermediate configuration 180 to the installed configuration 52, the pivoting assembly 220 may pivot the first end 106 of the shroud 90 onto the receiving surface 210 and enable a remaining portion of the shroud 90 to be raised above (e.g., in an upward direction, with respect to the direction of gravity 24) the lips 166. To this end, the pivoting assembly 220 may enable transfer of substantially all of a weight of the fan 18 from the lips 166 to the support rail 122 and the threaded rod 222. Indeed, as shown in the illustrated embodiment of FIG. 10, in the installed configuration 52 of the fan 18, the surface 212 of the shroud 90 may be offset from the lip 166 of the second guide rail 104 by a gap 270, such that the surface 212 may not contact on the lip 166. Therefore, it should be appreciated that the surface 212 may also be offset from the lip 166 of the first guide rail 102 in the installed configuration 52 of the fan 18.

Figure 11:
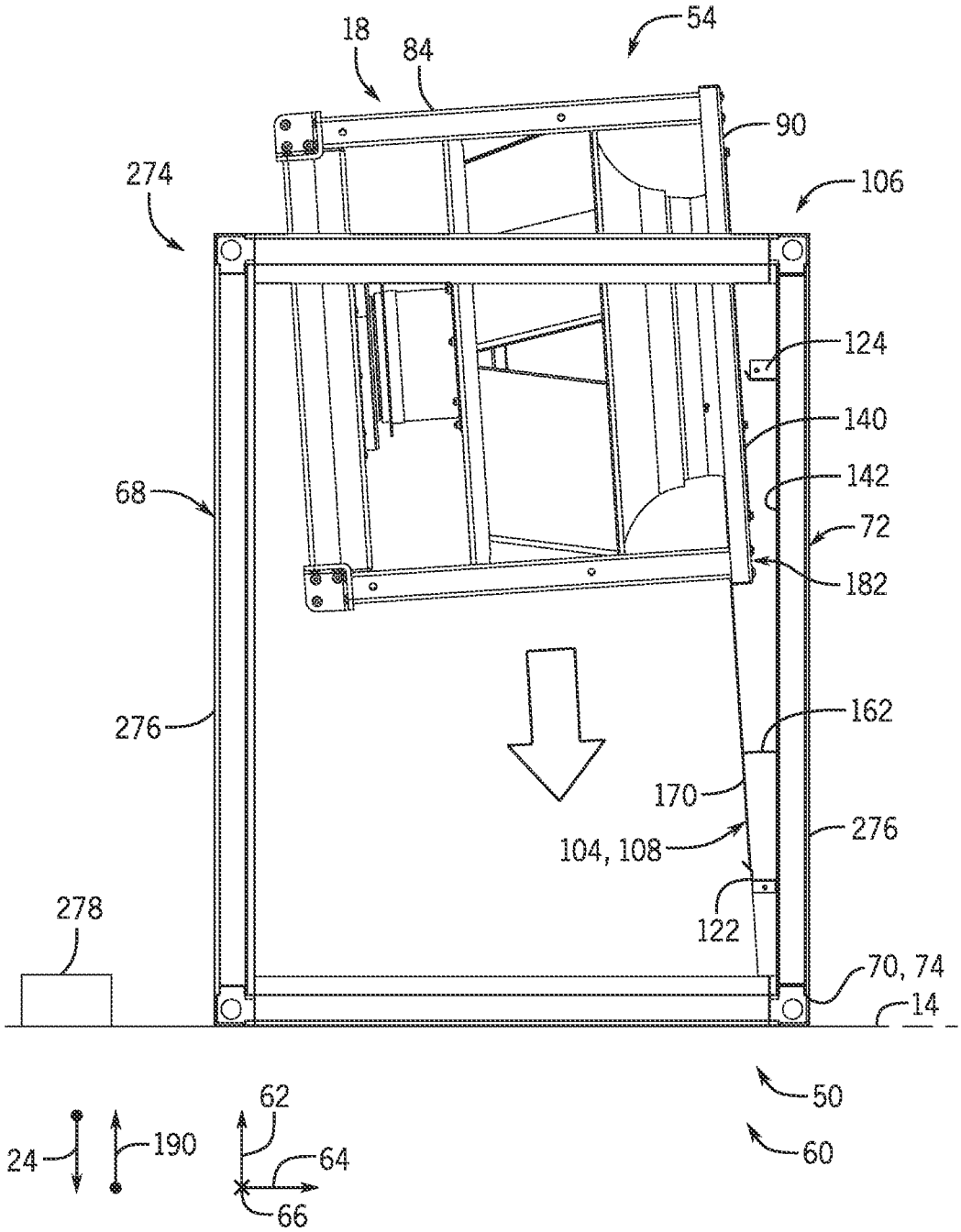
FIG. 11 is a side view of an embodiment of a portion of a fan assembly, illustrating a fan positioned in an initial configuration on a mounting assembly, in accordance with an aspect of the present disclosure.

Although the mounting assembly 50 has been described as facilitating transitioning of the fan 18 between the initial configuration 54 and the installed configuration 52 via movement generally along the longitudinal axis 64, it should be appreciated that the mounting assembly 50 may be positioned in any suitable orientation to facilitate movement of the fan 18 between the initial configuration 54 and the installed configuration 52 along a particular direction or axis. For example, FIG. 11 is a side view of an embodiment of a portion of the fan assembly 60, illustrating the mounting assembly 50 positioned in a vertical orientation 274 and the fan 18 positioned in the initial configuration 54 with the mounting assembly 50. For clarity, it should be understood that the first guide rail 102 is hidden in the illustrated embodiment of FIG. 11 to better illustrate the features and operation of the mounting assembly 50 discussed below.

However, it should be understood that the first guide rail 102 may engage with and interact with the fan 18 in a manner that is substantially similar to or identical to the engagement and interaction between the fan 18 and the second guide rail 104 discussed herein. Operation of the mounting assembly 50 in the vertical orientation 274 may be substantially similar to the operation of the mounting assembly 50 discussed above. Particularly, in the illustrated embodiment, the fan 18 may slide along the guide rails 108 generally along the direction of gravity 24 to transition from the initial configuration 54 to the installed configuration 52, for example. The fan 18 may slide along the guide rails 108 generally along the upward direction 190 to transition from the installed configuration 52 to the initial configuration 54, for example. In some embodiments, the fan assembly 60 may include a hoist 278 (e.g., a crane) that may be configured to couple to a component (e.g., the shroud 90) of the fan 18 and is operable to facilitate moving the fan 18 along the guide rails 108 to transition the fan 18 between the initial configuration 54 and the installed configuration 52.

Figure 12:
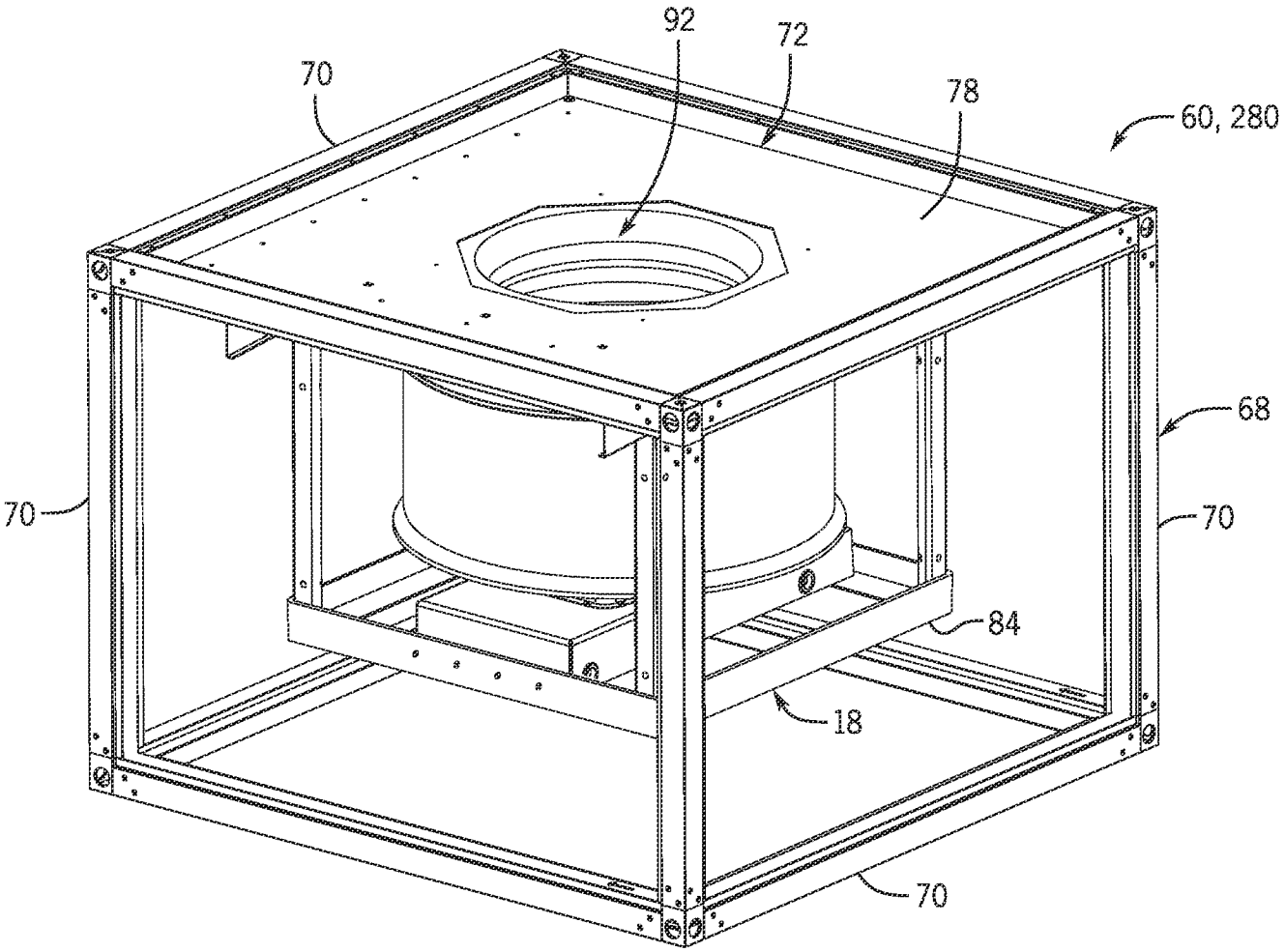
FIG. 12 is a perspective view of an embodiment of a fan assembly having a mounting assembly for mounting a fan in an HVAC unit, in accordance with an aspect of the present disclosure.

FIG. 12 is a perspective view of another embodiment of the fan assembly 60, referred to herein as a fan assembly 280, in which the fan 18 is in the installed configuration 52 and the mounting panel 72 does not include the secondary support panels 80. Indeed, in certain embodiments, the primary support panel 78 may span between certain beams 70 of the frame 68.

Figure 13:
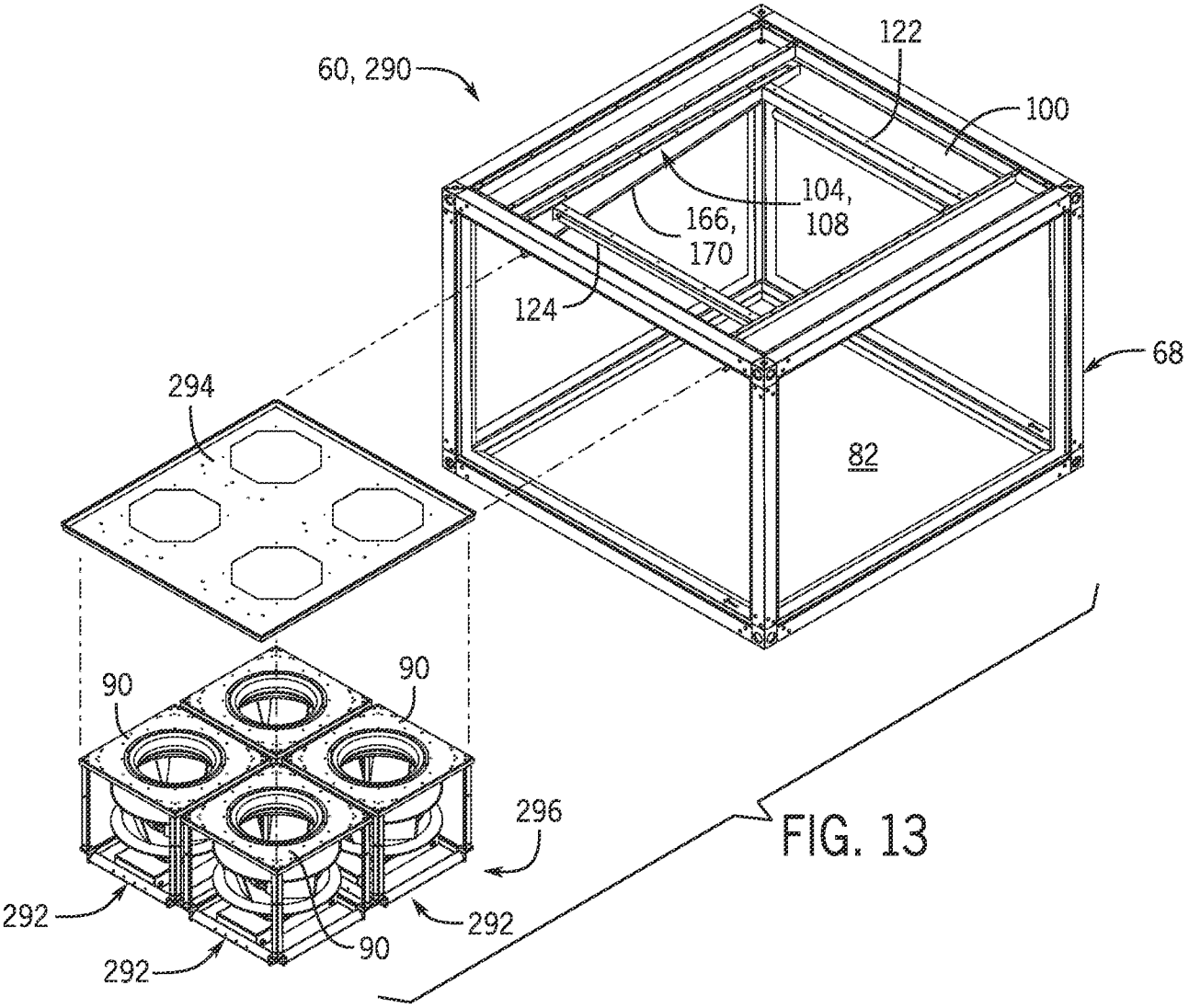
FIG. 13 is a perspective view of an embodiment of a multi-fan assembly having a mounting assembly for mounting multiple fans in an HVAC unit, in accordance with an aspect of the present disclosure.

FIG. 13 is a perspective view of another embodiment of the fan assembly 60, referred to herein as a multi-fan assembly 290, including a plurality of fans 292 (e.g., multiples of the fan 18). As shown in the illustrated embodiment of FIG. 13, the multi-fan assembly 290 includes the frame 68 and the railing assembly 100 coupled to the frame 68. The multi-fan assembly 290 includes a multi-fan shroud 294 that is configured to couple to respective shrouds 90 of the plurality of fans 292. As such, the multi-fan shroud 294 may support the plurality of fans 292 as a cohesive assembly. The multi-fan shroud 294 may be configured to engage with the lips 166 of the guide rails 108 in a similar manner as the individual shroud 90 of the fan 18 discussed above. That is, the multi-fan shroud 294 may be configured to engage with and translate along the guide rails 108 in accordance with the aforementioned techniques to facilitate transition of the multi-fan assembly 290 between a removed configuration 296, such as the initial configuration 54, in which the fans 292 are extracted from or partially extracted from the frame 68, and an installed configuration, such as the installed configuration 52, in which the fans 292 are coupled to the frame 68, supported by the frame 68, and/or otherwise positioned within the interior region 82 of the frame 68. In some embodiments, the pivoting assembly 220 may be configured to engage with (e.g., couple to) the frame 68 and to the multi-fan shroud 294 to facilitate transition of the multi-fan assembly 290 between an intermediate configuration on the guide rails 108 and the corresponding installed configuration with the frame 68 (e.g., the installed configuration 52) in accordance with the aforementioned techniques.

As set forth above, embodiments of the present disclosure may provide one or more technical effects useful for enabling simplified and improve installation and removal of a fan from an enclosure of an HVAC unit. In particular, the disclosed mounting assembly may reduce a complexity involved in performing inspection, maintenance, or performance of other operations on a fan mounted within the HVAC unit and, thus, reduce a time period and cost associated with completion of such tasks. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A mounting assembly for a fan of a heating, ventilation, and/or air conditioning (HVAC) system, comprising:

a frame configured to couple to the HVAC system and comprising a support rail, wherein the support rail comprises a flange and a tongue extending obliquely from the flange;

a first guide rail coupled to the frame and comprising a first lip extending at an oblique angle relative to the flange; and a second guide rail coupled to the frame and comprising a second lip extending at the oblique angle relative to the flange, wherein the first lip and the second lip are configured to support and guide translation of a chassis of the fan toward the support rail, wherein the tongue is configured to engage the chassis and guide translation of the chassis atop the flange, with respect to a direction of gravity, and wherein the flange is configured to support a weight of the fan to suspend the fan offset from the first lip and the second lip in an installed configuration of the fan with the mounting assembly.

2. The mounting assembly of claim 1, comprising a pivoting assembly coupled to the frame and configured to engage with the chassis, wherein the pivoting assembly is configured to pivot the chassis relative to the first lip and the second lip to transition the fan from a resting configuration on the first guide rail and the second guide rail to the installed configuration.

3. The mounting assembly of claim 2, wherein the first guide rail and the second guide rail are configured to orient the fan at the oblique angle in the resting configuration of the fan.

4. The mounting assembly of claim 2, wherein the pivoting assembly comprises a threaded rod configured to engage with corresponding threads of a component of the chassis.

5. The mounting assembly of claim 2, comprising an actuator configured to drive operation of the pivoting assembly to transition the fan from the resting configuration to the installed configuration.

6. The mounting assembly of claim 1, wherein the first guide rail and the second guide rail are configured to suspend the fan above a surface of the HVAC system, with respect to the direction of gravity.

7. The mounting assembly of claim 1, wherein the tongue extends from the flange at an additional oblique angle relative to the flange, wherein the additional oblique angle is different from the oblique angle.

8. The mounting assembly of claim 7, wherein the flange comprises a receiving surface configured to engage the chassis, and wherein the receiving surface is positioned vertically above the first lip and the second lip with respect to the direction of gravity.

9. The mounting assembly of claim 1, comprising an abutment rail coupled to the frame and extending between the first guide rail and the second guide rail, wherein the abutment rail includes an additional tongue extending therefrom, and wherein the additional tongue is configured to engage with the chassis and guide translation of the chassis toward the support rail.

10. The mounting assembly of claim 1, wherein the first lip extends toward the second guide rail and the second lip extends toward the first guide rail to form a channel between the first guide rail and the second guide rail, wherein the channel is configured to receive a shroud of the chassis.

11. A mounting assembly for a fan of a heating, ventilation, and/or air conditioning (HVAC) system, comprising:

a frame defining an interior volume and comprising a first end configured to receive the fan and a second end opposite the first end;

a support rail coupled to the frame, wherein the support rail comprises a flange and a tongue extending obliquely from the flange;

a plurality of guide rails coupled to the frame, wherein each guide rail of the plurality of guide rails comprises a guide surface configured to guide translation of the fan through the first end of the frame, into the interior volume toward the second end of the frame, and into engagement with the tongue, wherein the tongue is configured to guide translation of the fan atop the flange, with respect to a direction of gravity, such that the fan is positioned in a first orientation; and a retention system configured to engage the fan to secure the fan in a second orientation within the interior volume, wherein the fan is disposed at an angle relative to the guide surfaces in the second orientation, and wherein the retention system and the flange are configured to support a weight of the fan in the second orientation.

12. The mounting assembly of claim 11, wherein the retention system is configured to engage with and enable translation of the fan between the first orientation and the second orientation.

13. The mounting assembly of claim 11, wherein the frame and the retention system are configured to cooperatively support the fan in the second orientation such that at least a portion of the fan is offset from the guide surfaces.

14. The mounting assembly of claim 11, wherein the support rail comprises a receiving surface configured to support the fan in the second orientation, wherein the guide surfaces extend at an oblique angle relative to the receiving surface.

15. The mounting assembly of claim 14, wherein the tongue extends at an additional oblique angle relative to the receiving surface that is different than the oblique angle.

16. The mounting assembly of claim 14, wherein the receiving surface is positioned vertically above the guide surfaces with respect to the direction of gravity.

* * * * *